US010215350B2

(12) United States Patent
Vredenborg

(10) Patent No.: US 10,215,350 B2
(45) Date of Patent: Feb. 26, 2019

(54) LUMINAIRE, ESPECIALLY FOR ROAD LIGHTING

(71) Applicant: PHILIPS LIGHTING HOLDING B.V., Eindhoven (NL)

(72) Inventor: Arno Vredenborg, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 4 days.

(21) Appl. No.: 15/313,052

(22) PCT Filed: May 13, 2015

(86) PCT No.: PCT/EP2015/060532
§ 371 (c)(1),
(2) Date: Nov. 21, 2016

(87) PCT Pub. No.: WO2015/177007
PCT Pub. Date: Nov. 26, 2015

(65) Prior Publication Data

US 2017/0184265 A1 Jun. 29, 2017

(30) Foreign Application Priority Data

May 22, 2014 (EP) ..... 14169492

(51) Int. Cl.
*F21S 4/00* (2016.01)
*F21S 8/08* (2006.01)
(Continued)

(52) U.S. Cl.
CPC ..... *F21S 8/086* (2013.01); *F21V 5/02* (2013.01); *F21V 7/05* (2013.01); *F21V 7/10* (2013.01);
(Continued)

(58) Field of Classification Search
CPC ..... F21S 8/086; F21W 2131/101; F21W 2131/103; F21V 5/02; F21V 7/05; F21V 7/10; F21V 13/04
(Continued)

(56) References Cited

U.S. PATENT DOCUMENTS

2009/0097248 A1* 4/2009 Tsao ..... F21V 5/02 362/246
2009/0129072 A1 5/2009 Oza
2011/0019404 A1 1/2011 Chien et al.

FOREIGN PATENT DOCUMENTS

CN 102686934 A 9/2012
DE 202010005862 U1 9/2010
(Continued)

*Primary Examiner* — Anh Mai
*Assistant Examiner* — Matthew Peerce

(57) ABSTRACT

The invention provides a luminaire for illuminating a road, comprising a light source (10), a reflector arrangement (12) defining a light entrance window (18) at the top to which light is supplied by the light source (10) and a larger light exit window (20) at the bottom, and an optical plate (22) over the light exit window (20). The optical plate (22) comprises an array of elongate prisms which each extend in a side-to-side direction corresponding to the width direction of the road. The reflector (12) is primarily responsible for control of the light output in the road width direction and the optical plate (22) is primarily responsible for control of the light output in the road length direction.

15 Claims, 10 Drawing Sheets

(51) Int. Cl.

| | |
|---|---|
| ***F21V 5/02*** | (2006.01) |
| ***F21V 7/05*** | (2006.01) |
| ***F21V 7/10*** | (2006.01) |
| ***F21V 13/04*** | (2006.01) |
| *F21W 131/103* | (2006.01) |
| *F21Y 105/10* | (2016.01) |
| *F21Y 115/10* | (2016.01) |

(52) U.S. Cl.
CPC ..... *F21V 13/04* (2013.01); *F21W 2131/103* (2013.01); *F21Y 2105/10* (2016.08); *F21Y 2115/10* (2016.08)

(58) Field of Classification Search
USPC ..... 362/249.02
See application file for complete search history.

(56) References Cited

FOREIGN PATENT DOCUMENTS

| | | | |
|---|---|---|---|
| EP | 2690355 | A1 | 1/2014 |
| JP | 2011222316 | A | 11/2011 |
| WO | WO2011080767 | A1 * | 7/2011 |

* cited by examiner

LUMINAIRE, ESPECIALLY FOR ROAD LIGHTING

CROSS-REFERENCE TO PRIOR APPLICATIONS

This application is the U.S. National Phase application under 35 U.S.C. § 371 of International Application No. PCT/EP2015/060532, filed on MAY 13, 2015, which claims the benefit of European Patent Application No. 14169492.7, filed on MAY 22, 2014. These applications are hereby incorporated by reference herein.

FIELD OF THE INVENTION

This invention relates to luminaries for road lighting.

BACKGROUND OF THE INVENTION

Road luminaires are designed such that a certain luminance from the road is achieved with a required uniformity according to governmental specifications.

These specifications are particularly demanding in respect of the uniformity of the luminance in the direction of the road that the driver encounters in a particular lane. Moreover, it is required that the intensity of the light that can shine directly into a driver's eyes is limited. Too much light that shines directly into the driver's eyes leads to glare which can be dangerous for a driver. Thus, there is a careful balance in the light distribution for a road luminaire in the direction of the road that achieves the required uniformity and keeps the glare within the required specifications.

The preferred light source now used in road luminaires is a light emitting diode (LED) (in practice an array thereof), which typically emits the light in a Lambertian distribution. This distribution differs somewhat from the required light distribution.

A lens can be designed that is placed directly onto the LED to generate the required light distribution. An alternative to a luminaire consisting of LED plus lens is to use a tapered reflector placed around the LED plus an optical plate in front of the reflector to redirect the light to the required light distribution.

The optical plate may consist of micrometer to millimeter sized prismatic elements placed in a pixelated way.

The design and manufacture of the optical plate can however be complicated.

EP2690355A1 and US20090097248 both disclose a luminaire comprising a light source, a reflector arrangement and an optical plate with a prismatic structure with prismatic ridges extending in a side-to-side direction.

SUMMARY OF THE INVENTION

The invention is defined by the claims.

According to the invention, there is provided a luminaire for illuminating a road, the luminaire having a side-to-side direction corresponding to the road width direction in use, and an end-to-end direction corresponding to the road length direction in use, the luminaire comprising:

a light source;

a reflector arrangement having opposite sides and opposite ends, and defining a light entrance window at the top to which light is supplied by the light source and a larger light exit window at the bottom; and an optical plate over the light exit window, the optical plate comprises an array of elongate prisms which each extend in the side-to-side direction, each prism of the optical plate has an upright side and has an upper face of which a vertical makes a prism angle ($\gamma$) to a vertical to the optical plate, wherein the prism angle ($\gamma$) increases from a central prism for an inner section of the optical plate extending outwardly from the center, and the prism angle decreases for the outer section of the optical plate extending outwardly to the outer edge, and wherein each prism faces the light source with its upper face.

In this arrangement, a reflector performs a light redirection function perpendicular to the road direction whereas the optical plate principally redirects light in the direction of the road, because it is formed of side-to-side elongate prisms. This allows the optical plate to be simpler to design, with the shape of the prismatic element varying only in one dimension. This can result in an optical plate that is cheaper to manufacture, for example by extrusion, embossing or other conventional techniques.

The optical plate may have a design which can be independent of the luminaire source dimension (i.e. the entrance window direction) in the direction of the road and the height of the reflector. The prisms facing with an upper face towards the light source instead of with the upright face enables less sharp facets, thus reducing the risk on damage to the prisms. Furthermore, it surprisingly appeared possible to obtain the desired light distribution via refraction (possibly in combination with TIR) in only one step, i.e. each light ray only propagates through only one (respective) optical plate via a single (respective) optical element on said optical plate. The specific design of the reflector in combination with the specific design of the optical plate enabled a further tweaking of the desired light distribution.

The design may be optimized to provide maximum uniformity in the direction of the road while satisfying requirements with respect to glare. In particular, the luminaire converts the light distribution of the light source, which may comprise an LED or LED array, into a light distribution that is suitable for an outdoor road luminaire in the direction of the road.

The opposite sides and the opposite ends may be planar. This provides a simple to design and manufacture reflector.

The light exit window may have a dimension in the end-to-end direction of 100 mm to 400 mm and the height of the reflector arrangement may be in the range 50 mm to 150 mm. These dimensions are particularly suitable for a road lighting application.

The ends of the reflector arrangement preferably extend at an angle $\alpha$ to the vertical, which is in the range 40 degrees to 70 degrees, more preferably 45 degrees to 65 degrees. These angle ranges are found to give low amounts of reflected light in the plane across the road direction and with a low intensity ratio between maximum and minimum intensity.

The light intensity distribution in a plane parallel to the end-to-end direction may for example have a maximum at an angle in the range 60 to 75 degrees to the vertical. This may different to the inherent distribution of the light source, which may be an LED with a Lambertian output.

Each prism of the optical plate preferably has an upper face with a vertical, (i.e. a normal direction to the upper face) which makes a prism angle $\gamma$ to the vertical, wherein the prism angle to the vertical for a central prism is zero or a small angle such as less than 10 degrees. The optical plate may be symmetrical about a side-to-side line passing along the central prism.

The prism angle γ increases from the central prism for an inner section of the optical plate extending outwardly from the center, and the prism angle decreases for an outer section of the optical plate extending outwardly to the outer edge. Thus, the prisms may have a specific angle γ with respect to the vertical (i.e. the normal to the optical plate) that is a one dimensional function with respect to the dimension of the plate in the direction of the road. This provides a design which is simple to design and manufacture.

The prism angle γ at the outer edge may be in the range 0 to 25 degrees. The prism angle γ may have a maximum value within an intermediate section between the inner section and the outer section, wherein the maximum angle is in the range 15 to 40 degrees.

Thus, from the center of the optical plate in an outward direction (along the road direction), the prism angles γ increase from zero in a first region, then there is an intermediate region where the angle is a maximum, and the angles decrease in an end region. The intermediate region may comprise a set of prisms for which the prism angle γ is the same.

The reflector height is preferably in the range of 0.5 to 5 times the size of the light entrance window in the end-to-end direction.

The elongate prisms may be straight or curved. The number of prisms is preferably in the range 20 to 2000 (more preferably 20 to 400) and the prism width is at least 20 microns.

The luminaire may comprise an array of light sources, each with their own respective reflector arrangement, wherein each light source also has a respective optical plate or else an optical plate is shared between the light sources.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides a luminaire for illuminating a road, comprising a light source, a reflector arrangement defining a light entrance window at the top to which light is supplied by the light source and a larger light exit window at the bottom, and an optical plate over the light exit window. The optical plate comprises an array of elongate prisms which each extend in a side-to-side direction corresponding to the width direction of the road. The reflector is primarily responsible for control of the light output in the road width direction and the optical plate is primarily responsible for control of the light output in the road length direction.

Figure 1B:
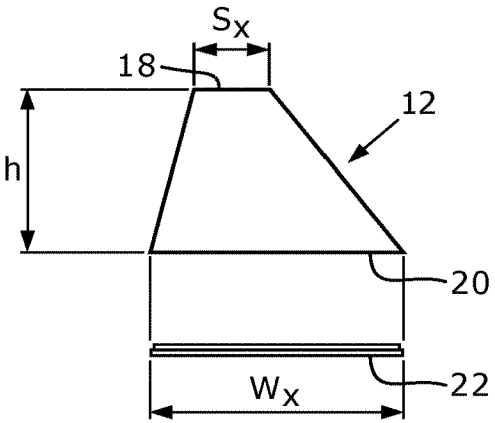
FIG. 1*a-c* shows an example of luminaire geometry.
Figure 1C:
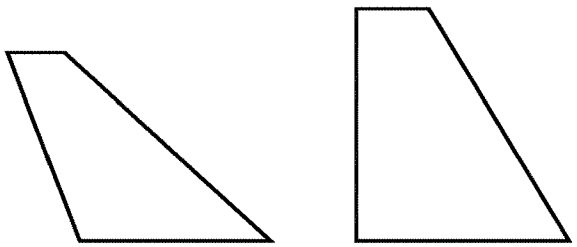
Figure 1A:
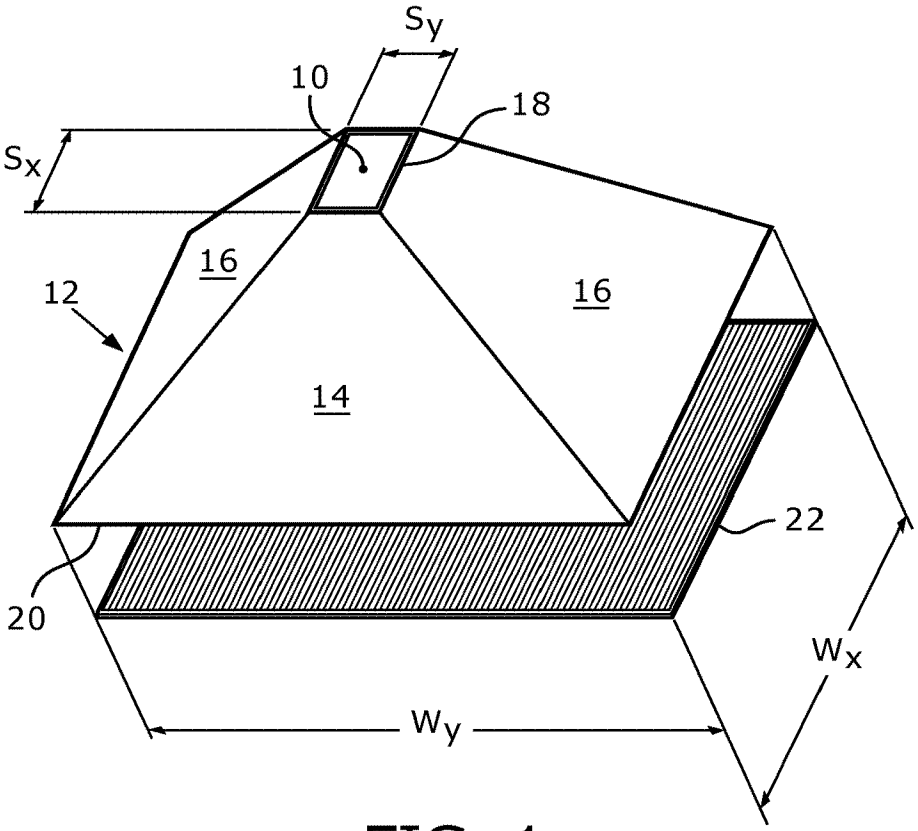

A luminaire in accordance with an embodiment is shown in FIG. 1. FIG. 1(*a*) is a perspective view and FIG. 1(*b*) is view of one end, looking along the direction of the road.

The luminaire comprises a light source 10, and a reflector arrangement 12 having opposite sides 14 and opposite ends 16, and defining a light entrance window 18 at the top to which light is supplied by the light source 10. A larger light exit window 20 is defined at the bottom.

The luminaire is for lighting a road and is designed to be oriented in a particular way with respect to the road. Defining the road width as extending in an x-axis direction and the road length as extending in the y-axis direction, the entrance window (and light source) has a dimension in the x-axis direction of $S_x$ and a dimension in the y-axis direction of $S_y$. The exit window has a dimension in the x-axis direction of $W_x$ and a dimension in the y-axis direction of $W_y$.

The x-axis can be considered to define a side-to-side direction and the y-axis can be considered to define an end-to-end direction.

The entrance window and light source can be square, but they can be rectangular with non-unity aspect ratio between the direction of the road (y-axis) and perpendicular to it (x-axis). For example the source dimension of the source in the x-axis dimension can be more than 5 times the source dimension in the y-axis dimension. Typically, the ratio of x-axis dimension to y-axis dimension is typically in a range of 0.2-10.

On the bottom side of the reflector 12 and covering the exit window 20 is an optical plate 22 that consists of lines of prismatic optical structures that are oriented along the x-axis side-to-side direction, namely perpendicularly to the road direction. The x-axis dimension of the exit window 20 is determined by the source dimension in the x-axis $S_x$, the height h of the reflector and the intended road geometry. The angle of the two reflector sides 14 (which form planes parallel to the road direction) are determined by the road geometry. The dimension of the exit window in the x-axis direction is thus mainly determined by the height of the reflector for a given angle of the sides 14. In particular $W_x=2\ h \tan\theta+S_x$ where θ is the angle to the vertical made by the sides 14 (assuming they are symmetrical).

One example of a possible luminaire geometry for a typical road geometry has an entrance window (and source size) of 20 mm×20 mm in combination with a reflector that is 40 mm in height (h) and an optical plate of $W_x$=75 mm and $W_y$=160 mm.

FIG. 1 shows the sides 14 each tapering outwardly from the entrance window 18, so that the entrance window is located approximately (or exactly) above the center of the exit window. However, the entrance window may be to one side of the structure, so that the two reflector sides 14 slope in the same general direction. As shown in the end view of FIG. 1(*b*) the sides do not need to extend at the same angle. Alternative configurations are shown in FIG. 1(*c*).

The optical plate can have straight prism lines. Such a linear structure of the plate means the plate can be made using a variety of conventional low cost ways. For example, extrusion is a cheap option, but also hot embossing or injection molding can be used.

The optical plate is for example a transparent polycarbonate or Polymethylmethacrylate (PMMA). For PMMA an additional protection from the outside is desired and a glass plate can be placed adjacent the optical plate or on the bottom of the luminaire. As another example, the optical plate may comprise a transparent silicone bonded onto a glass window.

Figure 2:
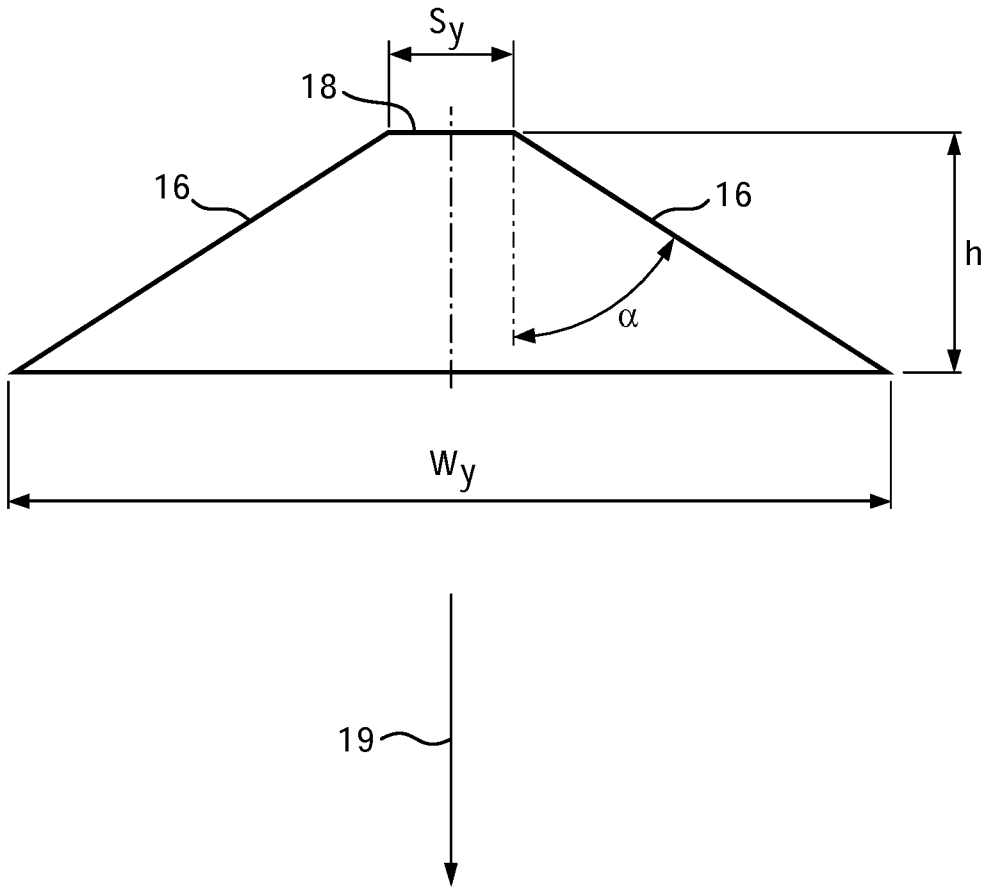
FIG. 2 shows the reflector geometry in the end-to-end direction parallel to the road direction.

FIG. 2 shows a side view of the reflector. An important parameter is the angle of the reflector ends 16 with respect to the vertical, shown as α. The arrow 19 represents the downward vertical axis. There are several aspects that determine a suitable design for the reflector, particularly the angle α. Two important criteria are:

1. A minimal amount of reflected light is desired from the end faces 16. A value below 20% is considered to be acceptable. The end faces 16 redirect the light vertically downwards, so that the light which exits the light source is redirected to have a smaller angle with respect to the downwards vertical. However, the intention for the luminaire is to radiate light that makes a large angle with respect to the downward vertical. The smaller the angle α becomes, the more light is redirected by the reflector end faces 16 (assuming the light source is emitting with a Lambertian distribution). The amount of light falling from the source onto the two end surfaces can indeed be made to be approximately 20% of the total amount of light emitted by the source, and this can be seen from FIG. 4 below.

The redirection of the light by the reflector in this way has to be compensated for by the optical plate, but only a limited amount of redirection is possible by refraction in the optical plate. Therefore, the angle α should not be too small and can be chosen according to the amount of reflected light.

The optical plate could be designed assuming light that shines only directly from the source to the exit window. Then the light distribution from a Lambertian source has to be transformed into a light distribution desired for the outdoor lighting. However, the reflector redirects light to fall with different angles on the optical plate and these should be taken into account.

Furthermore, large angles with respect to the normal from the source are required for the illumination of a large road length (in the y-axis direction) from a modest mounting height. For example, the illuminated road length is desired to be 2.5-5 times the luminaire height, which implies large angle α. Reflected light makes a much smaller angle to this normal. Therefore, light that is reflected has to be redirected to large angles again.

2. The intensity ratio of the illuminance provided from the optical plate has a desired value. This intensity ratio is the ratio between the highest and lowest intensity illuminance onto the optical plate from the LED source (possibly via the reflector). This ratio should not be too large, otherwise there would be parts of the plate where there is practically no light falling onto it and thus it makes no sense to make this part of the plate.

If an LED light source is used, it radiates with a Lambertian light distribution that has a lower intensity at large angles with respect to the normal to the light emitting surface. The maximum intensity is somewhere directly below the light source, and the minimum intensity is at the edge most distant from the source. The larger the reflector angle α, the smaller will be the minimum intensity on the optical plate. The surface area of the optical plate with an undesirably high intensity ratio should be limited. An intensity ratio below 20 is considered to be acceptable.

With these two objectives, optical simulations have been performed on a variety of reflector geometries to determine the two criteria for each design.

Designs are simulated based on reflector heights in the range 50 mm-150 mm, x-axis dimensions $W_x$ of the exit window in the range 60 mm-150 mm and y-axis dimensions $W_y$ of the exit window in the range 100-400 mm. The intensity ratio is affected because a minimum intensity arises in the corners of the optical plate.

The source was positioned in the center above the entrance optical window in these simulations.

Figure 3:
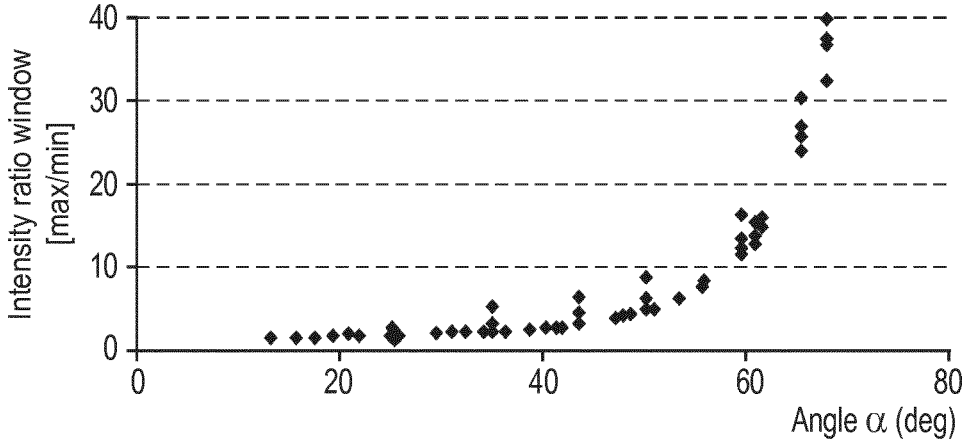
FIG. 3 shows the intensity ratio plotted for a number of reflector designs with varying angles α of the reflector ends in the direction of the road.

FIG. 3 shows the intensity ratio of the light emitted from the exit window as a function of the angle α. An intensity ratio below 20 is achieved by an angle up to approximately 65 degrees.

Figure 4:
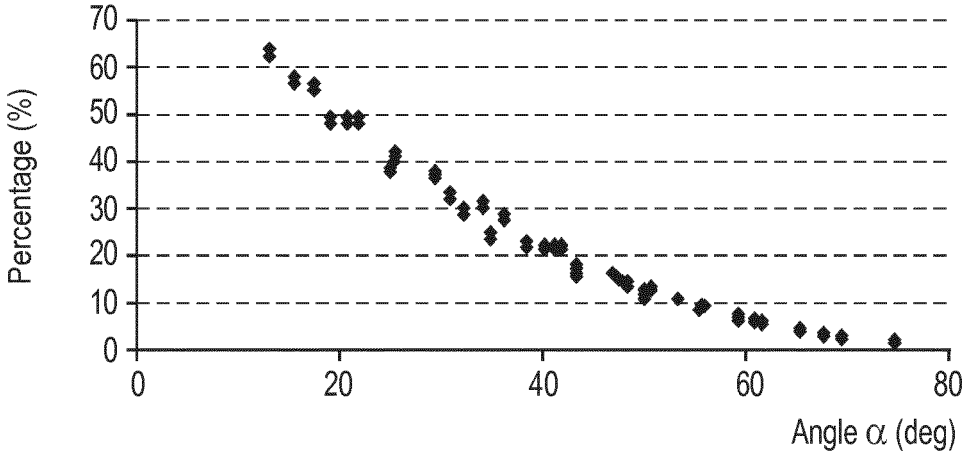
FIG. 4 shows the percentage of reflected light versus the angle α of the reflector ends.

FIG. 4 shows the percentage of reflected light from the exit window as a function of the angle α. The percentage is below 20% for angles larger than approximately 45 degrees.

This leads to a range for the reflector angle α between approximately 45 and 65 degrees. However, slightly smaller or larger angles (+−5 degrees) can be used if less stringent ratios are defined, giving a range of 40 degrees to 70 degrees.

Figure 5:
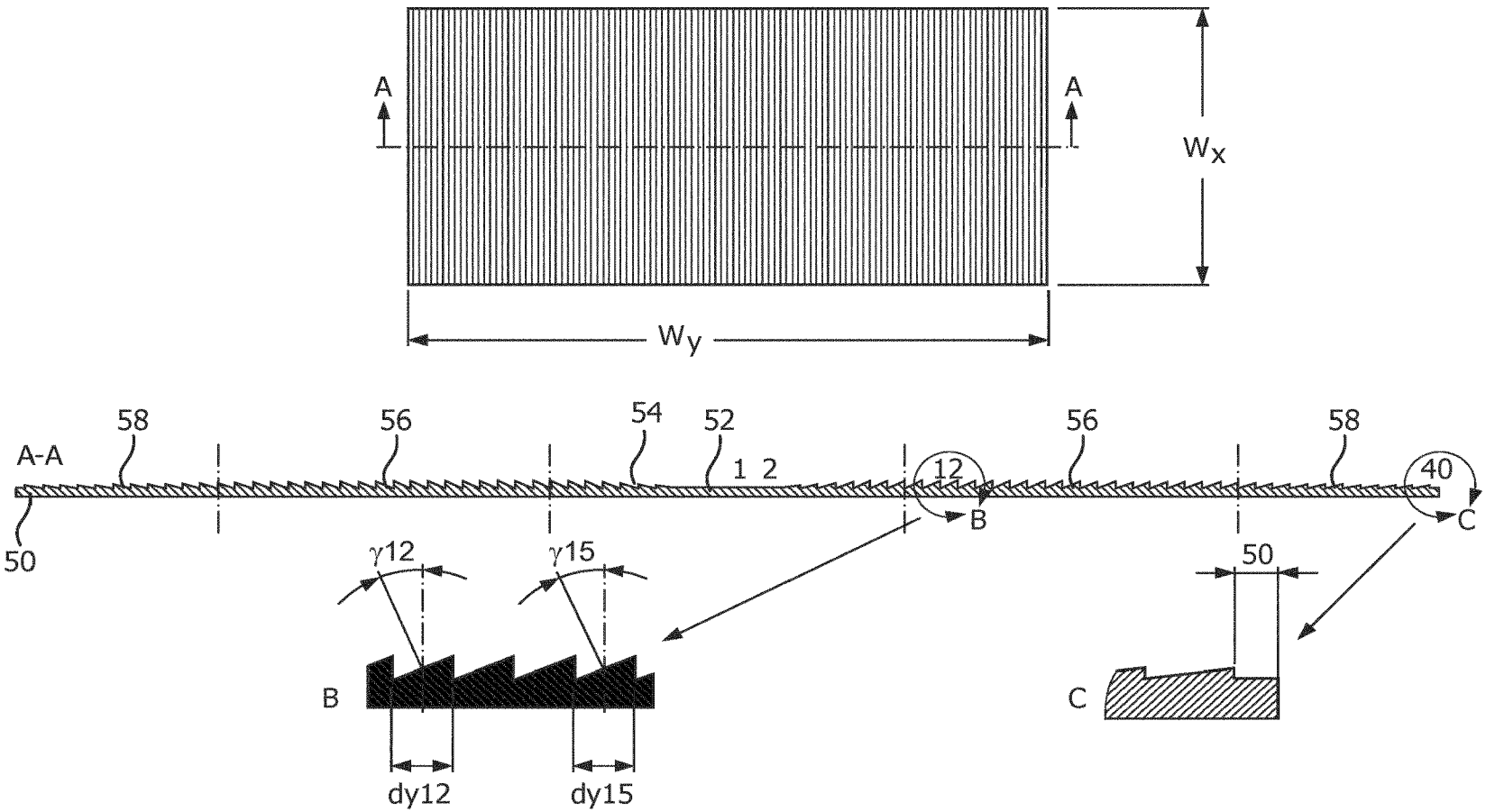
FIG. 5 shows the optical plate design in more detail.

FIG. 5 shows in more detail an example of the design of the optical plate.

The optical plate of this design has linear prism lines. The design is mirrorsymmetric in the x-z plane. The optical plate has a central prism 52 in an inner section 54, an intermediate section 56 in between the inner section and an outer section 58, the outer section being bordered by a border 50 (or outer edge 50).

The plate shown consists of 80 lines in total and the size of each prism in the y-axis dimension is dependent of the total exit window y-axis dimension $W_y$ and indicated as dy1 -dy40. The mirror symmetry means there are 40 possible different dimensions.

Each prism consists of a top facet that makes an angle γ1-γ40 with respect to the vertical as shown in detail B. The numbering is selected with element 1 located in the center of the plate and element 40 on the outside. Each element can have a unique angle γ1-γ40, but the angles of the elements are related to another and represent a continuous function along the y-axis. The function enables the design to correctly transform the light distribution from the LED (plus reflector) .

A single prism in the example shown consists of a top facet with an angle γn (where n is the facet number, i.e. γ1 to γ40) with respect to the vertical and a vertical edge slope, thereby forming a sawtooth type shape. However, the edge slope does not have to be exactly vertical. For example, it is possible to have around a 2 degree angle in the edge slope and approximately the same light distribution can be obtained.

The angles for the prism top facets could then be corrected slightly to compensate for the angle. A slight angle to the sawtooth uprights allows for a better injection molding because the plate has to be extracted from the mold.

FIG. 5 also shows that a border 50 can be provided around the plate that is not part of the prism line. This may be more difficult to make in an extrusion process, but would be straightforward in injection molding or hot embossing.

The border can for example be used to seal the inside of the luminaire to the external environment by sandwiching a rubber/silicone ring between the plate and the reflector housing with a clamp for example.

Figure 6:
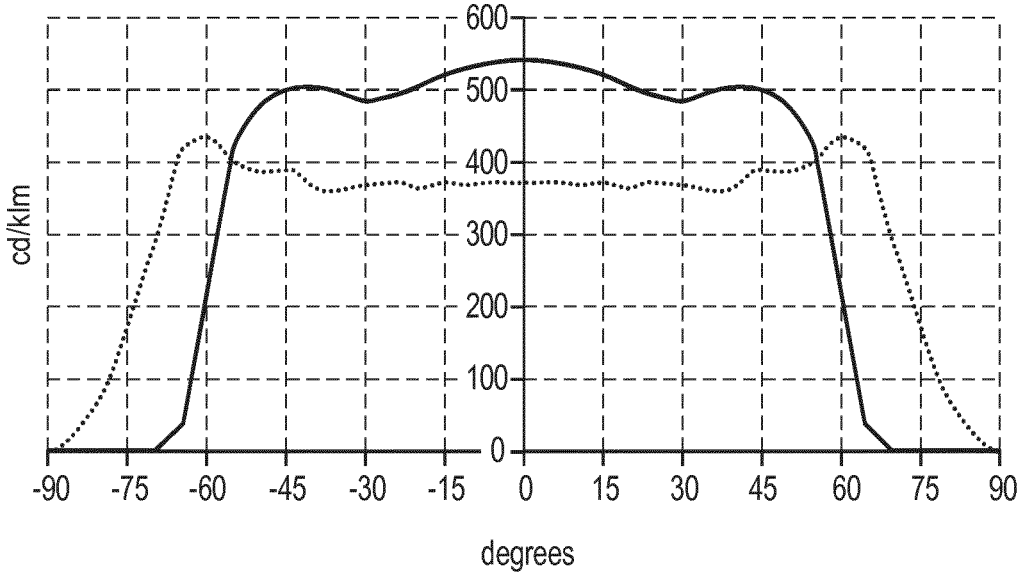
FIG. 6 is a cross section along the y-axis direction (road direction) of the light distribution of the LED plus reflector (solid line) and a target distribution generated in combination with the optical plate (dotted line)

The light intensity of the LED plus reflector is shown in FIG. 6 as the solid plot, and the target light distribution that is generated by the combination with the optical plate shown as a dotted plot. The y-axis shows a normalized intensity in candela for a 1000 lumen source (cd/klm), for a plane in the road direction, namely the yz plane, and with respect to the angle to the vertical as plotted on the x-axis. The solid plot has highest intensity around a zero degree angle (direct downward light from the light source), while the target distribution of the dotted plot has a minimum at zero degrees. The target distribution has higher intensity at larger angles and a relatively sharp intensity fall-off between 70 and 90 degrees. The light intensity distribution in this yz plane parallel to the end-to-end direction is a maximum at an angle in the range 60 to 75 degrees to the vertical.

This light distribution leads to a high uniformity and has a glare value that satisfies the specifications for the best road class. The best road class is most demanding in terms of intensity (high), uniformity (high) and glare (low). In particular, the target distribution is characterized by a smooth function with a peak around 65-70 degrees and sharp fall-off at larger angles up to 90 degrees. No light should be emitted at larger angles, because the light would be lost to the sky. This is favored by the design of the reflector, having a smaller angle.

Figure 7:
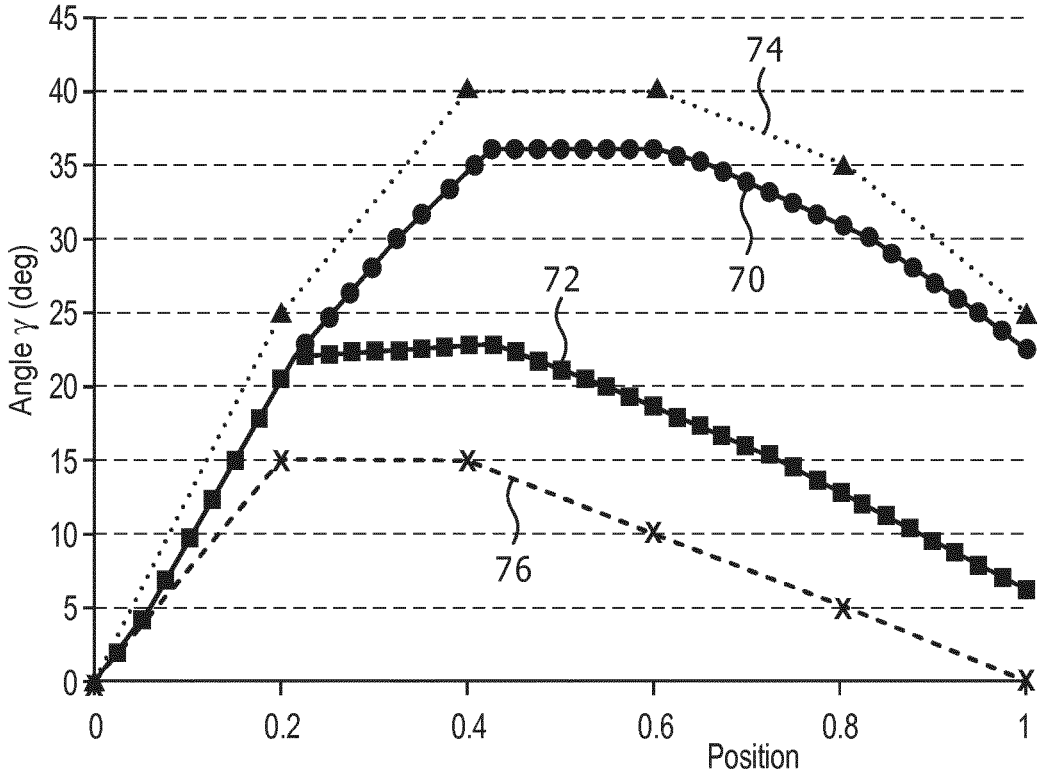
FIG. 7 shows the angle function which defines the way the angles γ of the facets of the optical plate evolve with distance, and for two reflector angles α.

The function which determines the individual facet angles $\gamma$1 to $\gamma$40 is shown in FIG. 7 for two reflector angles, $\alpha$=50 degrees (plot 70) and $\alpha$=60 degrees (plot 72). The two functions are described by a linear interpolation between 6 points, and there are 40 points in total on each plot representing the 40 facets on each side of the center.

In FIG. 7, the x-axis plots the distance from the center of the optical plate to the outermost edge (along the y-axis direction), as a fractional value, so that 1 represents the edge and 0 represents the middle. The y-axis plots the local facet angle $\gamma$1 to $\gamma$40.

The functions can be applied to any number of facets. Typically, the minimum number of elements is around 20. Decreasing the number further will reduce the uniformity achieved due to pixellation effects. There is not necessarily a maximum number of elements, but the maximum is determined by diffraction. The width of each element may for example preferably be at least 25 times larger than the wavelength of light. Taking 750 nm light, the element width should be larger than 20 microns. This leads to a minimal dimension of the plate of 400 microns (20 elements×20 microns). For a 100 mm plate dimension, this would result in 5000 lines (100 mm /20 microns). A more practical implementation will have larger prism elements, for example 50 to 100 microns wide which reduces the number of lines to 1000-2000.

The tilt angle in this example is zero degrees for a central prism in the middle of the optical plate, namely directly below the light source, although more generally a small tilt angle may be used, for example less than 10 degrees.

The two functions shown are characterized by a linear increase in angle $\gamma$ for the first 20% of the plate from the middle. Shown in FIG. 7 is a linear increase up to element 8 of 40. Obviously, for a plate with twice as many prism lines, 80 on each side, the linear increase would continue to element 16 to achieve the same function.

At 20% of the plate (element 8 in the example shown), the angle $\gamma$ has increased up to approximately 20 degrees+−5 degrees. The margin is dependent on the distance between the edge of the light source and the reflector edge. Ideally, the reflector closes tightly around the light emitting area of the LED. In this case, 20 degrees provides good results.

For flexibility in the choice of the light source, a mounting can be designed which enables different light source sizes with the same optical configuration. This would lead to a gap between the light source and reflector that causes a shift in position of the light incident on the optical plate that can be solved by changing the angles slightly.

The elements between 20% and 60% of the plate are characterized by a 20% period of approximately zero change in tilt.

This occurs for the 50 degree reflector (plot 70) after a further 20% period of angle increase, while for the 60 degree reflector (plot 72) the range 20-40% has the approximately constant angle.

Then, a decrease in tilt is implemented to a value at the edge between 0 and 25 degrees. The 0 angle $\gamma$ at the edge arises for larger reflector angles ($\alpha$=65 to $\alpha$=70 degrees). The maximum angle $\gamma$ is higher for a smaller reflector angle, as can be seen in FIG. 7 for plot 70.

It is possible to simplify the function of the angle $\gamma$ over the plate. In general, the angle $\gamma$ as a function of the fraction of the plate increases almost linearly for the first 20%-40% from the middle of the plate, which starts at zero tilt. Then a period of almost constant angle $\gamma$ is observed and then an almost linear decrease to an angle at the edge between 0 and 25 degrees.

The upper and lower boundary for the angle $\gamma$ function is shown in FIG. 7 as plots 74 and 76. The lower boundary 76 is required for larger reflector angles $\alpha$ (65-70 degrees), while the upper boundary 74 is required for smaller reflector angles $\alpha$ (40-45 degrees).

The total exit window y-axis dimension $W_x$ scales with the reflector angle $\alpha$, source y-axis dimension $S_y$ and reflector height h.

In the same way as described above, the y-axis dimension $W_y$ of the optical plate comprises the tangent of the angle alpha $\alpha$ (in FIG. 2) times the reflector height h, doubled to cover both ends, and the source y-axis dimension $S_y$ is added to this width to make the total y-axis dimension $W_y$ of the optical plate. Thus, $W_y$=2h tan $\alpha$+$S_y$. The typical reflector height h to source dimension y-axis dimension $S_y$ is for example a factor 0.5-5.

This factor, between the reflector height and source length (along the road direction) is derived from the opening angle for the direct and indirect (or reflected) light that falls onto a single prism. This represents the range of incident angles of light which need to be processed by that prism.

For a 20 mm source and 40 mm reflector height, the maximum opening angle is approximately 26 degrees (inverse tangent of 0.5) for light that shines directly from the source into a prism element below the source. The opening angle is smaller for larger angles, but this makes the optics easier to design. The dimension of the prism line is neglected in this simple calculation, but this would increase the maximum opening angle to around 30-35 degrees. Also, reflected light is not considered, which would increase the opening angle as well.

However, the percentage of reflected light is kept to a minimum and thus can be neglected. Larger opening angles lead to less control of the light that can be redirected towards desired target angles and is thus more difficult. The opening angles are thus limited by specifying suitable reflector height and source dimensions.

The luminaire may comprise a number of modules, for example in the range 1-20 (more preferably 1 to 5) for providing a larger range of light flux.

Figure 8A:
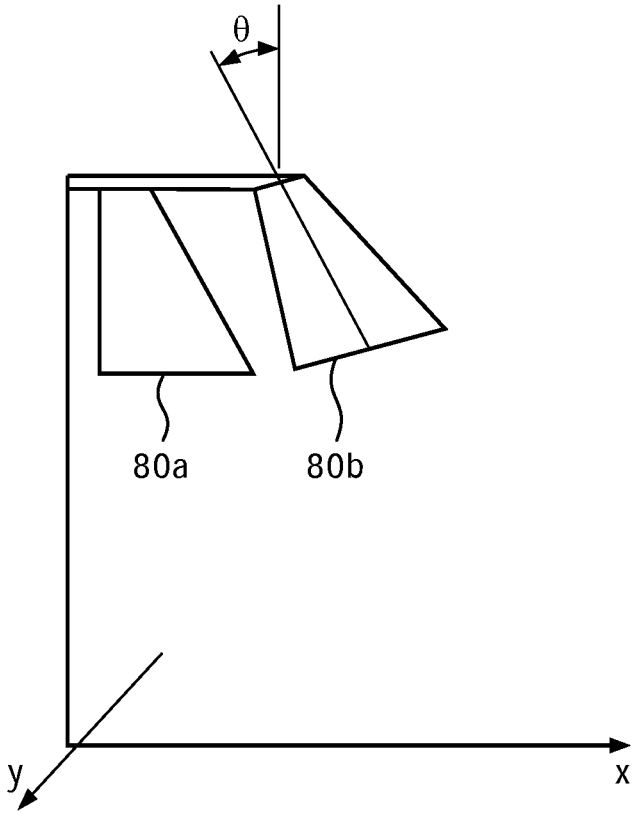
FIG. 8*a-b* shows how the lighting system may comprise a set of modules.
Figure 8B:
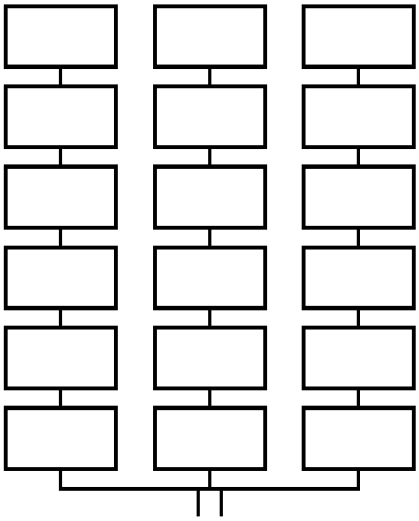

FIG. 8(*a*) shows an example in which two modules 80*a*,80*b* are provided side by side in the row width (x axis)

direction. The two modules are tilted to the vertical axis with respect to each other. The first module 80*a* has a range of light emission directions in the road width direction as explained above, and the second module 80*b* is at an outward tilt angle θ (i.e. tilted towards the opposite side of the road to the luminaire position) with respect to the first in the plane perpendicular to the road direction.

The luminaire may be built-up of smaller light flux modules for example with 3000-7500 lumen instead of having a single module with a large light flux (for example greater than 10000 lumen). This reduces the thermal management requirements as air gaps can be included between the modules. Furthermore, it allows for better performance of the luminaire in terms of overall uniformity or perpendicular to the road direction when the modules are tilted with respect to each other as shown in FIG. 8(*a*). Practical values for the tilt angle θ would be 1-15 degrees, preferably 5-10 degrees. For example, the modules may be aligned to different lanes in this way.

The modules do not necessarily have to be tilted and larger arrays are also possible where for example over 100 kilolumen (for example using 10-20 modules) is required from one light point.

FIG. 8(*b*) shows how larger arrays of modules may be formed, such as a 3×6 array.

The example above makes use of a large optical plate for a large source (dimensions of tens of mm). The dimensions of the reflector and optical plate can instead be scaled to the dimensions of a single LED (approximately 1 mm×1 mm). Then, an array of LEDs and reflectors can be used, with the spacing between the LEDs determined by the size of the reflector.

Figure 9C:
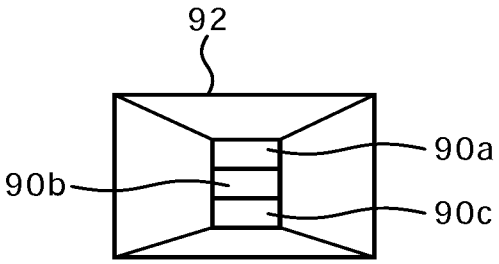
FIG. 9*a-c* shows an arrangement with one reflector for each LED or for each LED cluster.
Figure 9A:
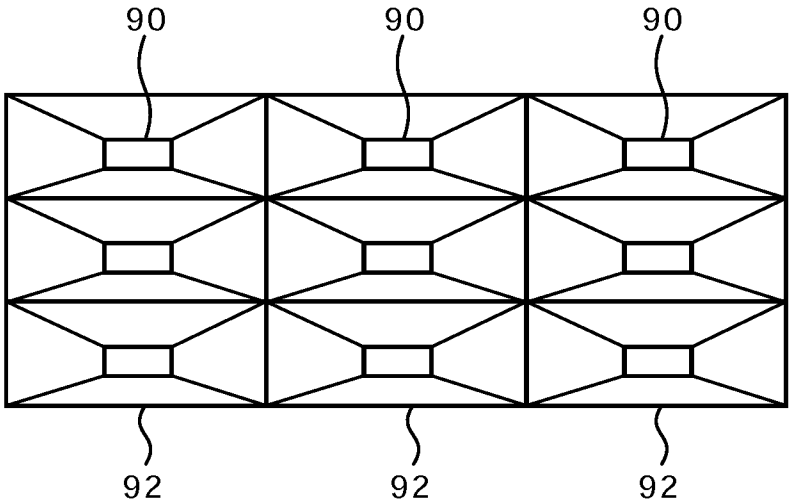
Figure 9B:
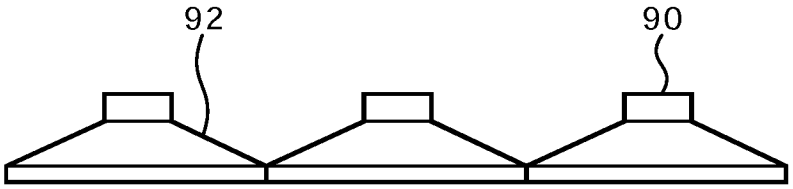

FIG. 9 shows this approach. The top view of FIG. 9(*a*) shows LEDs 90 each with their own reflector 92. FIG. 9(*b*) shows a side view.

This arrangement enables accurate selection of the total flux of the luminaire, using a single design of light source, for example emitting 50 to 100 lumen.

There may be a single LED for each reflector, or else as shown in FIG. 9(*c*) there may be a cluster of LEDs 90*a*, 90*b*,90*c* (three in the example shown) for each reflector 92, for example 90*a*,90*b*,90*c* are RGB LEDs to enable simple color adjustment.

These designs can be implemented in a stacked way. For example, a PCB can be formed with an array of LEDs or an array of LED clusters. A plastic sheet can then be provided with holes for the reflector by injection molding, and this can be coated with reflective silver coating. A prism line optical plate can be then placed on top, so that the optics plate is shared between all LEDs.

This design would require less alignment between the parts and would generate a distributed source, which could be more favorable in terms of thermal cooling. A concentrated source generates significant heat on a small area and requires careful thermal design. This is less demanding for distributed sources.

The examples above also make use of straight prism lines. The lines do not have to be straight (i.e. linear), but they can have a radius in the xy plane of the exit window, and/or in the yz plane.

Figure 10:
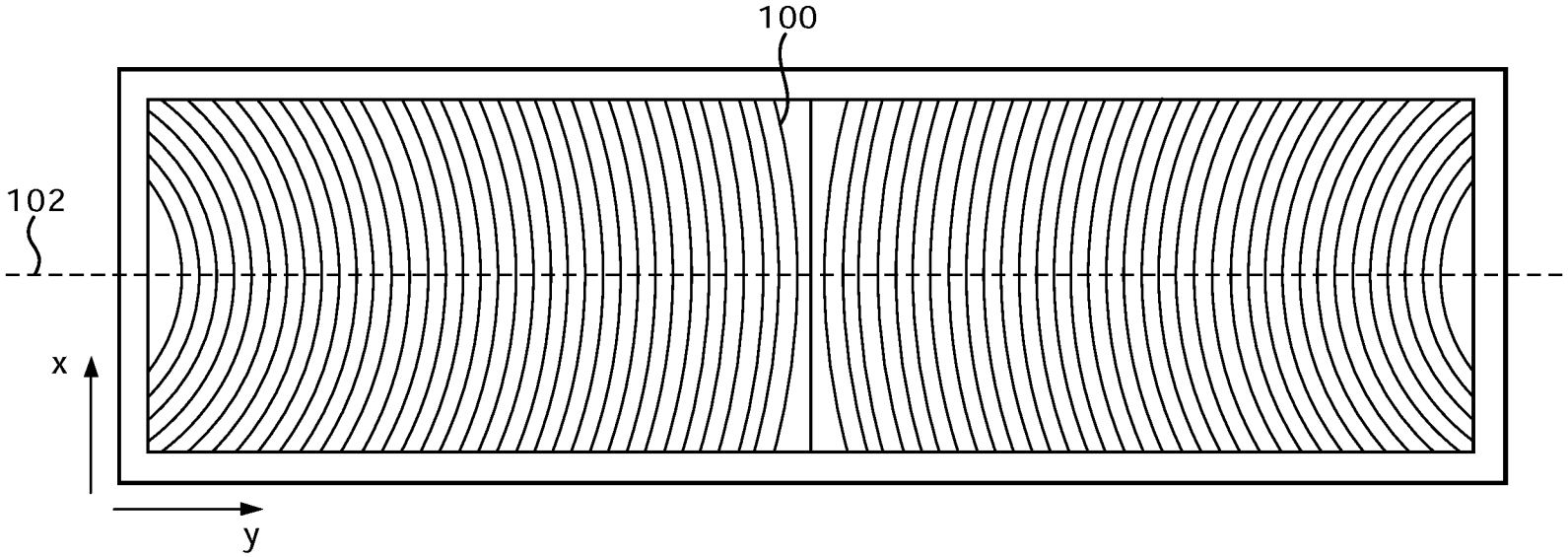
FIG. 10 shows an alternative version with curved lines of varying radius.

FIG. 10 shows an embodiment with curved lines 100 of varying radius in the xy plane, the elongate prisms are curved prisms in the side-to-side direction, the curved prisms facing with a convex curvature towards the light source The angle function as described above (for the facet angles) can be determined for a cross section of the optical plate such as the center line 102 in the y-axis direction. However, the x-position of the line can be located at another position, for example depending on the source position with respect to the optical exit window.

The curved lines 100 do not necessarily have to follow a fixed radius, the center of the radius can be displaced in the x-coordinate, or elliptical shapes can be used. A cross-section through the yz plane will somewhere display the desired angle function which relates the individual facet angles (α1 to α40).

The cross section of the prism line is taken perpendicular to its local direction. The fact angle γ in this cross section then follows the desired design rules, for example as shown in FIG. 7. The facet angle (within this perpendicular cross section) is for example constant along the length of the prism line, even if the prism line is curved. Thus, the design of the optical plate remains simple.

The prism geometry can be adjusted to alter the optical performance of the luminaire. For example, as shown in FIG. 11(*a*), the more upright sides of the prisms do not necessarily need to be vertical.

Figure 11A:
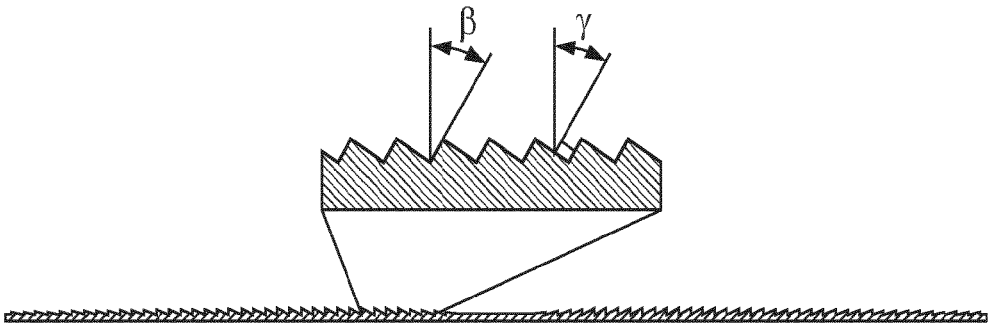
FIG. 11*a-b* show a different design of the optical plate.
Figure 11B:
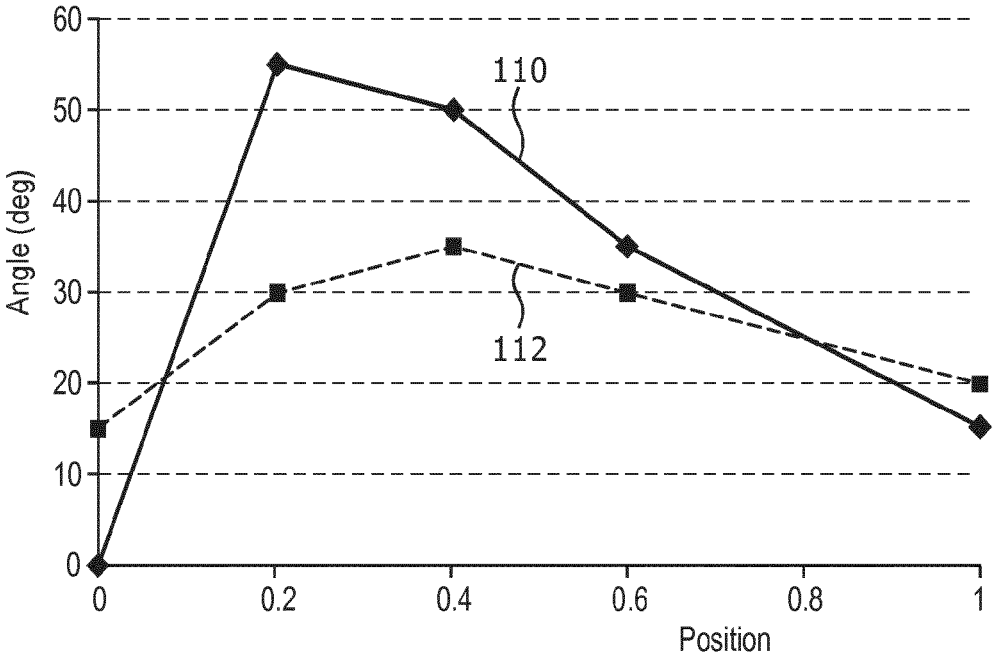

In FIG. 11(*a*), each facet comprises a relatively upright side which is however offset by an angle β from the vertical and a relatively flat top side which has a normal at an angle γ to the vertical. The additional slant angle β enables a larger angle γ of the top facets, which enables more refraction of light towards larger angles with respect to the downwards vertical at the exit of the optical plate.

The slant angle β is typically between 15 to 35 degrees, and the top facet angle α is typically between 0 to 55 degrees.

FIG. 11(*b*) shows a function for the angles as a function of the position within the plate. The x-axis shows the position as a fraction from the center (in the same way as FIG. 7). Plot 110 shows the angle γ and plot 112 shows the angle β.

FIG. 10 shows an embodiment with curved lines in the xy plane. A radius can also be located in the xz plane along the x axis or parallel to it. This results also in linear prism lines, although the height will vary.

Figure 12:
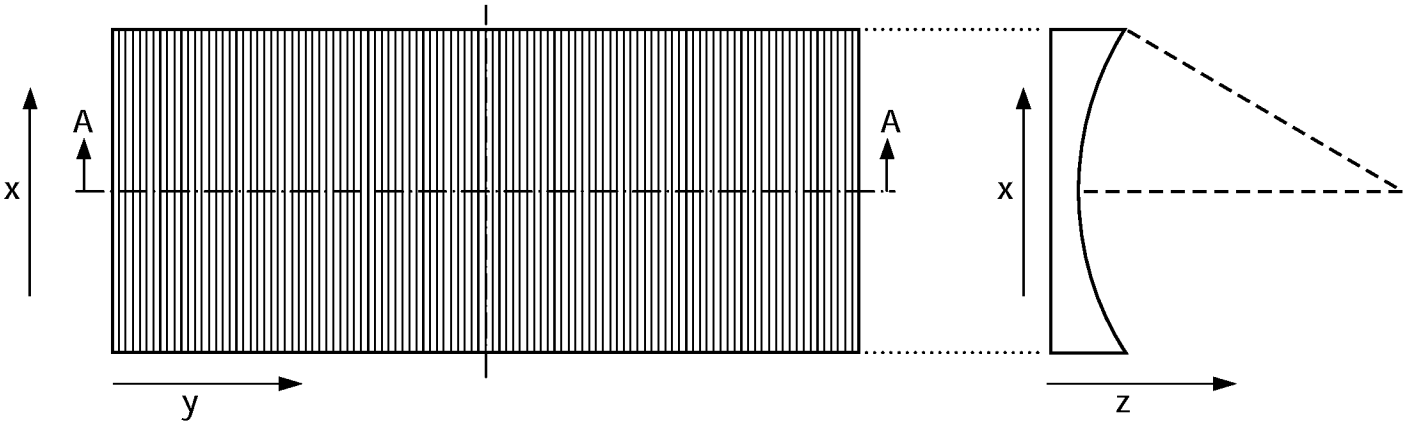
FIG. 12 shows an alternative version with varying thickness of optical plate.

An example is shown in FIG. 12, where a radius in the xz plane gives rise to a different optical plate thickness (i.e. z axis values) at different x-axis positions, as shown the curved prisms curved in the xz-plane face with a concave curvature towards the light source.

Thus, although the optical plate is described above as generally planar, with the prismatic structures projecting from this plane, a similar function can be found for a curved optical plate.

The invention can directly be applied in the design of outdoor road luminaires.

The light source is described above as an LED or LED array. However, other light sources can be used, such as a high pressure mercury discharge lamp or a halogen incandescent lamp. The light source generates visible white light, although it may have a colored light output.

An array of LEDs may include many LEDs such as 2 to 200.

The reflector can be formed in dye cast aluminum or formed as injection molded polycarbonate. A physical vapor deposition of aluminum or other reflective material such as silver can be used to enhance/generate the desired specular reflection and a transparent silicon oxide coating can be used for protection against corrosion. Alternatively, the reflector can be made from a single cut piece or reflector material set inside a luminaire housing.

Typically, the luminaries are mounted with a spacing along the road direction of between 2.5 and 5 times their mounting height. The factor of 5 is of course most demanding in terms of longitudinal uniformity. Moreover, the larger this factor, the higher the tilt of the prism elements as shown in FIG. 7. The lowest curve 76 for example corresponds to a smaller ratio (~3.5), while the higher curve 74 corresponds to a factor of 5.

The optical plate is described as having an array of prisms. By this is meant sloped light refracting upper facet surfaces. Generally, one side of the optical plate is flat and the other has the facet surfaces. However, both sides could have facet surfaces.

In the example above, the reflector has ends which are sloped with the same angle to the vertical ($\alpha$), and this means the optical plate can have a symmetric design, and the luminaire will provide the same lighting upstream and downstream. This provides an efficient use of the light sources, in that the maximum distance over which the desired light output can be provided is used, in both upstream and downstream directions.

However, this is not essential, and the reflector may have asymmetric ends.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A luminaire for illuminating a road, the luminaire having a side-to-side direction corresponding to a width direction of the road, and an end-to-end direction corresponding to a length direction of the road, the luminaire comprising:

a light source;

a reflector arrangement having opposite sides and opposite ends, the reflector arrangement defining a light entrance window to which light is supplied from the light source and a light exit window; and an optical plate over the light exit window, the optical plate comprising an array of elongate prisms, each of the elongate prisms extending along the side-to-side direction and having an upper facet, a normal direction of the upper facet being slanted by a prism angle with respect to a vertical direction of the optical plate, wherein, along the end-to-end direction, the prism angle of the elongate prisms increases from a central section of the optical plate to an intermediate section of the optical plate and then decreases from the intermediate section to an outer edge of the optical plate, and wherein the upper facet of the elongate prisms faces the light source.

2. The luminaire as claimed in claim 1, wherein the opposite sides and the opposite ends are planar.

3. All The luminaire as claimed in claim 1, wherein the light exit window has a dimension of 100 mm to 400 mm in the end-to-end direction and the reflector arrangement has a height in a range of 50 mm to 150 mm.

4. The luminaire as claimed in claim 1 wherein the opposite ends of the reflector arrangement extend at an angle to the vertical direction, ranging from 40 degrees to 70 degrees, or alternatively from 45 degrees to 65 degrees.

5. The luminaire as claimed in claim 1, wherein the light source comprises at least one LED.

6. The luminaire as claimed in claim 1, wherein the prism angle of a central prism of the elongate prisms is zero.

7. The luminaire as claimed in claim 6, wherein the optical plate is symmetrical about a side-to-side line passing along the central prism.

8. The luminaire as claimed in claim 1, wherein each of the elongate prisms has an upright side next to its upper facet, and wherein the upright side is offset relative to the vertical direction by an offset angle ranging from 15 to 35 degrees.

9. The luminaire as claimed in claim 1, wherein the prism angle at the outer edge ranges from 0 to 25 degrees.

10. The luminaire as claimed in claim 1, wherein the prism angle has a maximum value within the, intermediate section between the central section and the outer edge, wherein the maximum angle ranges from 15 to 40 degrees.

11. The luminaire as claimed in claim 10, wherein a set of the elongate prisms within the intermediate section has the same prism angles.

12. The luminaire as claimed in, claim 1, wherein a height of the reflector arrangement ranges from 0.5 to 5 times of a size of the light entrance window in the end-to-end direction.

13. The luminaire as claimed in claim 1, wherein the elongate prisms are curved prisms in the side-to-side direction.

14. The luminaire as claimed in claim 1, wherein a quantity of the elongate prisms ranges from 20 to 2000, and wherein a width of the elongate prisms, is at least 20 microns.

15. The luminaire as claimed in claim 1, comprising an array of light sources, each with their own respective reflector arrangement, wherein each light source also has a respective optical plate or else an optical plate is shared between the light sources.

* * * * *